US009902471B2

(12) United States Patent
Hellesmark et al.

(10) Patent No.: US 9,902,471 B2
(45) Date of Patent: Feb. 27, 2018

(54) METHOD AND SYSTEM FOR CARGO FLUID TRANSFER AT OPEN SEA

(71) Applicants: HiLoad LNG AS, Arendal (NO); TECHNIP FRANCE, Courbevoie (FR)

(72) Inventors: Svein Børge Hellesmark, Fevik (NO); Stéphane Paquet, Septeuil (FR)

(73) Assignees: HiLoad LNG AS, Arendal (NO); Technip France, Courbevoie (FR)

( * ) Notice: Subject to any disclaimer, the term of this patent is extended or adjusted under 35 U.S.C. 154(b) by 0 days.

(21) Appl. No.: 14/961,175

(22) Filed: Dec. 7, 2015

(65) Prior Publication Data

US 2016/0159439 A1 Jun. 9, 2016

Related U.S. Application Data

(60) Provisional application No. 62/089,037, filed on Dec. 8, 2014.

(51) Int. Cl.

| | |
|---|---|
| ***B63B 27/25*** | (2006.01) |
| ***B63B 25/12*** | (2006.01) |
| ***B63B 22/02*** | (2006.01) |
| ***B63B 27/34*** | (2006.01) |
| ***B63B 22/18*** | (2006.01) |
| *B63B 35/44* | (2006.01) |

(52) U.S. Cl.

CPC ..... *B63B 27/25* (2013.01); *B63B 22/021* (2013.01); *B63B 22/18* (2013.01); *B63B 25/12* (2013.01); *B63B 27/34* (2013.01); *B63B 2022/028* (2013.01); *B63B 2035/448* (2013.01)

(58) Field of Classification Search

CPC ..... B63B 27/25; B63B 27/30; B63B 22/021

USPC ..... 414/138.2, 138.3, 800; 441/4, 5; 114/230.21

See application file for complete search history.

(56) References Cited

U.S. PATENT DOCUMENTS

| | | | | |
|---|---|---|---|---|
| 3,366,088 A * | 1/1968 | Gibson | B63B 22/021 | 114/230.1 |
| 3,379,404 A * | 4/1968 | Anderson | B63B 22/021 | 251/26 |
| 3,674,062 A * | 7/1972 | Ellers | B63B 22/021 | 141/279 |

(Continued)

FOREIGN PATENT DOCUMENTS

| | | |
|---|---|---|
| EP | 2121462 | 11/2009 |

*Primary Examiner* — Joseph A Dillon, Jr.

(74) *Attorney, Agent, or Firm* — Andrus Intellectual Property Law, LLP

(57) ABSTRACT

Methods and systems are for transferring fluid cargo between a first vessel and a second vessel at open sea in a Parallel configuration. The first vessel is equipped with a cargo connection point and the second vessel is equipped with cargo manifold. A tubular line is connectable between the cargo connection point and the cargo manifold. The method can include attaching a self-propelled buoy to the second vessel; connecting a cargo connection between the self-propelled buoy and the cargo manifold; connecting a cargo line between the cargo connection point and the self-propelled buoy; transferring cargo between the cargo connection point and the cargo vessel; and relying on the self-propelled buoy to keep the self-propelled buoy within predetermined distance boundaries from the first vessel also when the self-propelled buoy is attached to the second vessel.

13 Claims, 5 Drawing Sheets

(56) References Cited

U.S. PATENT DOCUMENTS 3,881,530 A * 5/1975 Faldi ..... B63B 35/303 114/27
3,950,805 A * 4/1976 Murphy ..... B63B 22/021 405/203
4,339,002 A * 7/1982 Gibbs ..... B63B 22/021 141/387
6,484,658 B1 * 11/2002 Aaness ..... B63B 21/16 114/230.1
6,485,343 B1 * 11/2002 Børseth ..... B63B 22/021 114/258
6,935,390 B2 * 8/2005 Williamson ..... B63B 27/24 114/230.1
7,117,808 B2 * 10/2006 Kulikov ..... B63B 27/24 114/230.1
7,182,660 B2 * 2/2007 De Baan ..... B63B 22/023 114/230.1
7,470,163 B2 * 12/2008 Lokken ..... B63B 22/021 114/230.1
7,594,836 B2 * 9/2009 Kristensen ..... B63B 22/021 441/5
8,186,170 B2 * 5/2012 Boatman ..... B63B 21/50 114/230.12
8,402,983 B2 * 3/2013 Harland ..... B63B 22/026 137/1
8,448,673 B2 * 5/2013 Danaczko ..... B63B 27/24 137/899.2
8,800,607 B2 * 8/2014 Omar ..... B63B 27/24 114/230.13
9,114,859 B2 * 8/2015 Biaggi ..... B63B 27/24
9,688,362 B2 * 6/2017 Hellesmark ..... B63B 27/24
9,731,795 B2 * 8/2017 Deletre ..... B63B 27/24
2001/0020435 A1 * 9/2001 Ghignone ..... B63B 27/36 114/322
2004/0106339 A1 * 6/2004 Breivik ..... B63B 27/24 441/4
2004/0238176 A1 * 12/2004 Appleford ..... E21B 7/128 166/353
2005/0002739 A1 * 1/2005 De Baan ..... B63B 27/24 405/169
2005/0145154 A1 * 7/2005 De Baan ..... B63B 21/00 114/230.14
2007/0175377 A1 * 8/2007 Olsen ..... B63B 22/021 114/230.1
2008/0070456 A1 * 3/2008 Olsen ..... B63B 22/02 441/3
2008/0096448 A1 * 4/2008 Lokken ..... B63B 22/021 441/4
2009/0272459 A1 * 11/2009 Biaggi ..... B63B 27/24 141/1
2011/0223820 A1 * 9/2011 Lunde ..... B63B 22/023 441/5
2012/0317996 A1 * 12/2012 Lee ..... B63B 27/34 62/50.1
2013/0199616 A1 * 8/2013 Van Tassel ..... F16L 55/1015 137/1
2013/0240085 A1 * 9/2013 Hallot ..... B63B 27/24 141/311 R
2013/0295802 A1 * 11/2013 Tomas ..... B63B 21/00 441/3
2014/0345511 A1 * 11/2014 Rikoski ..... B22D 31/00 114/259
2015/0047546 A1 * 2/2015 Brizard ..... B63B 27/36 114/259
2016/0009353 A1 * 1/2016 Cooper ..... B63B 21/507 701/21
2016/0083051 A1 * 3/2016 Hellesmark ..... B63B 27/24 441/4

* cited by examiner

METHOD AND SYSTEM FOR CARGO FLUID TRANSFER AT OPEN SEA

CROSS REFERENCE TO RELATED APPLICATION

The present utility application relates to and claims priority to U.S. Provisional Patent Application Ser. No. 62/089,037 filed Dec. 8, 2014, which is hereby incorporated herein by reference in entirety.

FIELD

There is provided a method for cargo fluid transfer at open sea. More precisely there is provided a method for transferring fluid cargo between a first vessel and a second vessel at open sea in a Parallel configuration, and where the first vessel is equipped with a cargo connection point and where the second vessel is equipped with cargo manifold, and where a tubular line is connectable between the cargo connection point and the cargo manifold. The invention also includes a system for cargo fluid transfer at open sea.

For illustrative purposes, below, the first vessel is taken to be a Floating Natural Liquefied Gas Production Storage and Offloading Vessel (FLNG), and the second vessel is taken to be a Liquefied Natural Gas Carrier (LNGC). This example is purely illustrative and does not in any way limit the scope of the present disclosure.

BACKGROUND

The term "fluid" includes liquid and gaseous products.

Two methods and systems for fluid transfer between vessels at the open sea are common: the so-called "Tandem System" and the "Side-by-Side System".

When the Tandem System is used, the LNGC is typically located 80-150 m aft and "down weather" of the FLNG. As the vessels are kept at some distance from each other, the method is relatively safe from a collision point of view. Thus, the loading operation may be carried out under relatively high wave conditions.

As the LNGC normally has its manifold mid-ships, the cargo hoses, which may be aerial, floating or submerged, tend to be relatively long. A longer hose generally creates a higher pressure drop than a shorter hose, and it is often necessary to install increased pressure pumps in order to overcome the pressure drop. When loading LNG, more boil-off gas is generated with longer hoses and relatively large boil-off handling systems may be required.

When the Side-by-Side System is used, the LNGC is moored Side-by-Side relative the FLNG. The distance between them being only a few meters. The Side by Side System is relatively weather sensitive due to the risk of collision between the vessels.

The main advantage of the Side-by-Side System is that the distance between the manifold of the LNGC and the FLNG is relatively short. Traditional loading arms, short hoses, or similar that stretches through the air between the two vessels, may be used. Floating or submerged hoses exposed to waves and current are therefore not required. Since the length of the fluid transfer system is shorter, the pressure drop in the hoses are lower and standard pumps may be utilized. When loading LNG, the amount of boil-off gas is also significantly lower.

EP 2121462 shows a vessel having azimuth thrusters installed in order to improve manoeuvrability during loading operations.

In this document, the term "Parallel" configuration is utilized, mainly to distinguish the present method and system from the "Side-by-Side" configuration. The meaning of the term Parallel configuration is defined in the description below, and includes positioning a second vessel by the help of a self-propelled buoy relatively close to a first vessel.

SUMMARY

The present inventor has found it desirable to remedy or to reduce at least one of the drawbacks of the prior art, or at least provide a useful alternative to prior art.

There is provided a method for cargo fluid transfer between vessels at open sea. A cargo line is connectable between a first vessel and a self-propelled buoy. The self-propelled buoy is attachable to a second vessel and designed to keep the self-propelled buoy safely within predetermined distance boundaries from the first vessel also when the second vessel is attached to the self-propelled buoy in a Parallel configuration.

The self-propelled buoy is equipped with a cargo connection that is connectable to a manifold on the second vessel.

In a first aspect the present disclosure relates more particularly to a method for transferring fluid cargo between a first vessel and a second vessel at open sea in a Parallel configuration, and where the first vessel is equipped with a cargo connection point and where the second vessel is equipped with cargo manifold, and where a tubular line is connectable between the cargo connection point and the cargo manifold wherein the method comprises:

attaching a self-propelled buoy to the second vessel;

connecting a cargo connection between the self-propelled buoy and the cargo manifold;

connecting a cargo line between the cargo connection point and the self-propelled buoy;

transferring cargo between the cargo connection point and the second vessel; and relying on the self-propelled buoy to keep the self-propelled buoy within predetermined distance boundaries from the first vessel also when the self-propelled buoy is attached to the second vessel.

The method may include: allowing the second vessel to turn a predetermined angle relative the first vessel.

The method may include attaching the self-propelled buoy to the second vessel prior to connecting the cargo line between the cargo connection point and the self-propelled buoy.

Generally, the first vessel may be designed to weather vane about a moored swivel. The first vessel may thus turn according to the direction of a resultant element force that may include force components from wind and current. The resultant element force may include any of wind, wave and current forces.

However, the first vessel may be equipped with thrusters that are designed to keep its heading stationary during Parallel loading operation, even when the resultant element force change its direction somewhat.

If the resultant element force changes and the first vessel maintains its heading, it may be desirable to let the second vessel turn relative the first vessel in order to head against the resultant element force.

Even though a standard second vessel may not have thrusters or bow propellers, all suitable second vessels have a propulsion machinery that includes a rudder, and an auto-pilot. In one embodiment of the method, after the connection of the self-propelled buoy to the second vessel, the desired direction of the second vessel may be kept by the propulsion machinery being controlled by the auto-pilot of the second vessel.

The self-propelled buoy may position and keep the second vessel in the desired position relative to the first vessel, while the desired heading of the second vessel may be kept by the second vessel itself.

For safety reasons it may be the best procedure to attach the self-propelled buoy to the second vessel at a distance, say a couple of nautical miles, from the first vessel. The self-propelled buoy may then safely bring the second vessel to a safe distance, say between 50 and a couple of hundred meters from the first vessel. A distance of approximately one hundred meters may be considered to be ideal from the view of both safety and cargo line length.

The method may include emergency disconnecting the cargo line between the cargo connection point and the self-propelled buoy and letting the second vessel with the self-propelled buoy attached, drift off from the first vessel.

If an unsafe situation should occur, the cargo line may be disconnected. As no mooring connection may then be present between the vessels, the second vessel may drift off from the first vessel or be moved away from the first vessel by the attached self-propelled buoy.

The method may include:

first attaching a DPS self-propelled buoy to the second vessel; and then attaching the self-propelled buoy with the cargo line connected to the second vessel.

The term DPS (Dynamic Positioning System) is here used to distinguish between two self-propelled buoys. Both may or may not have a DPS.

In some cases, it may be desirable to attach the DPS self-propelled buoy at a distance from the first vessel and let the DPS self-propelled buoy bring the second vessel to the safe distance from the first vessel. The self-propelled buoy may then have the cargo line already connected before attaching itself to the second vessel. Thus, the total time for attaching, connecting and loading may be significantly reduced, as the pick-up of the second vessel may be taken over by the DPS self-propelled buoy and the cargo line may be cooled down prior to the attachment of the self-propelled buoy.

A further advantage of having one self-propelled buoy each side of the second vessel can be a significant damping effect particularly of the roll motion of the second vessel. This may be particularly important when loading or unloading so-called Membrane LNG carriers as these are typically sensitive to LNG sloshing.

In a second aspect the present disclosure relates more particularly to a system for transferring fluid cargo between a first vessel and a second vessel at open sea in a Parallel configuration, and where the first vessel is equipped with a cargo connection point and where the second vessel is equipped with cargo manifold and where a tubular line is connectable between the cargo connection point and the cargo manifold wherein at least one self-propelled buoy, that is designed to be connectable to a cargo line extending from the cargo connection point, is connectable to the second vessel, there being a cargo connection that is connectable between the self-propelled buoy and the manifold of the second vessel, and where the self-propelled buoy is designed to keep the self-propelled buoy within predetermined distance boundaries from the first vessel also when the self-propelled buoy is attached to the second vessel.

The first vessel may be designed to weather vane, thus adapting itself to the resultant element force direction.

The cargo connection point may be at a position distant from a flare tower on the first vessel. A preferred position of the cargo connection point may be at a stern portion of the first vessel as this part of the first vessel may often be relatively free of other equipment.

Further, if or when the cargo connection point is positioned at the stern portion of the first vessel, the distance the second vessel may have to move in order to be removed from the first vessel, may be shorter than if the cargo connection point were positioned further forward on the first vessel.

The first vessel may be equipped with a support boom or reels for the cargo lines. The cargo line may thus be kept out of the sea.

For some cargoes, the cargo lines may be in the form of a hardpipe with swivels in order to avoid flexible lines.

If preferable, the cargo lines between the cargo connection point and the self-propelled buoy may be in the form of a submersible or floatable hoses or flexible lines.

A service vessel may be connectable to the second vessel, particularly to the bow of the second vessel, e.g. for the purpose of assisting the self-propelled buoy in keeping the second vessel's heading in line with the first vessel.

The predetermined distance boundaries may be defined by an inner distance boundary that may be defined by safety considerations, and an outer boundary that may be defined by the length of cargo lines.

The method and system may have a combined benefit of advantages from the Side-by-Side and Tandem loading system. For example, the relatively short flow lines from the first vessel to the cargo manifold specific to the Side-by-Side System can be maintained, while benefiting from the improved safety aspect specific to the Tandem System is present.

BRIEF DESCRIPTION OF THE DRAWINGS

There is now described in the following examples, illustrated in the accompanying drawings, wherein.

DETAILED DESCRIPTION OF THE DRAWINGS

Figure 1:
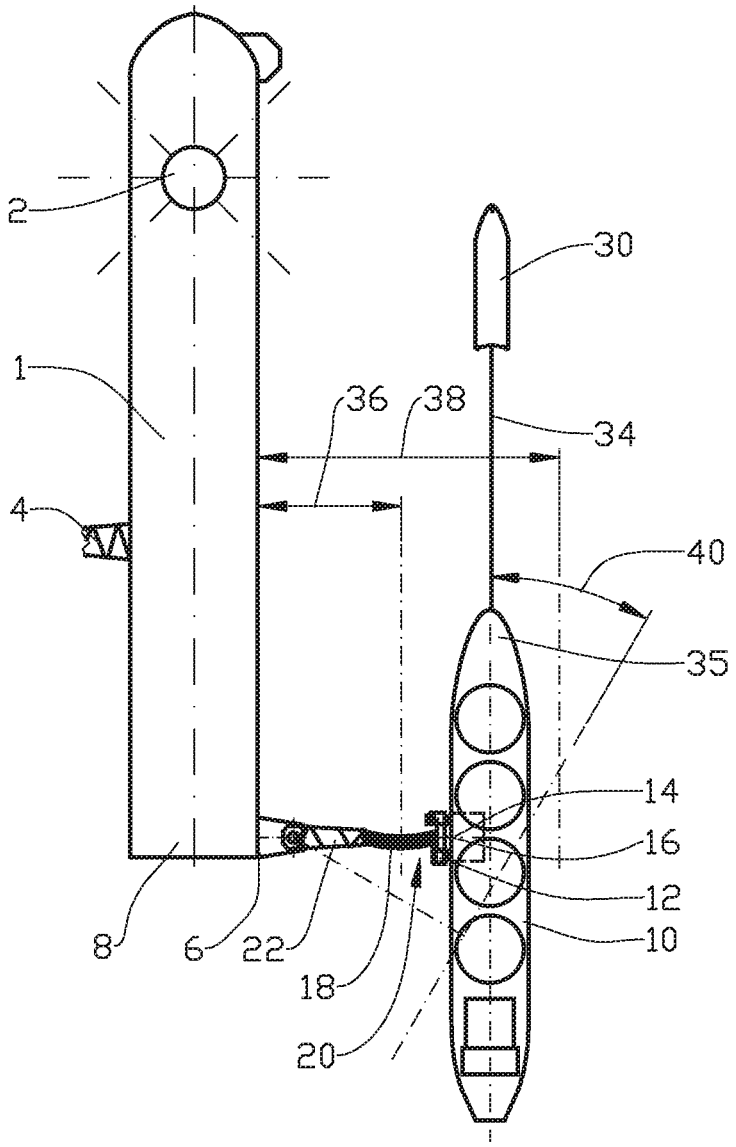
FIG. 1 shows a plane view of a first vessel and a second vessel connected for cargo fluid transfer according to the present disclosure.
Figure 2:
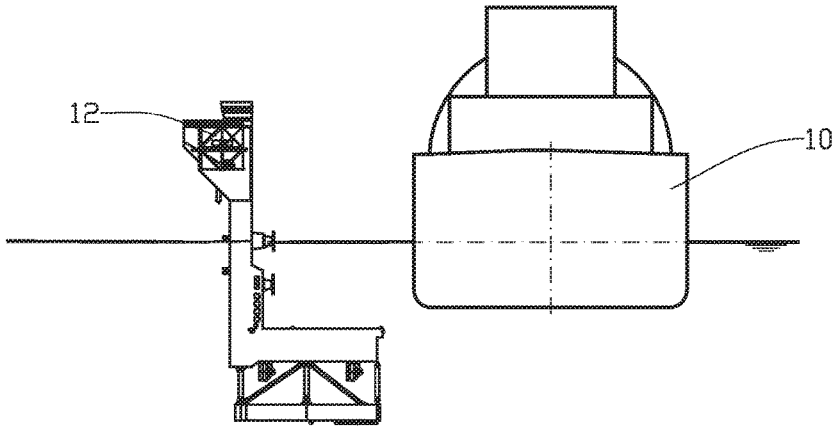
FIG. 2 shows to a larger scale an end view of a self-propelled buoy in the process of attaching itself to the second vessel.
Figure 4:
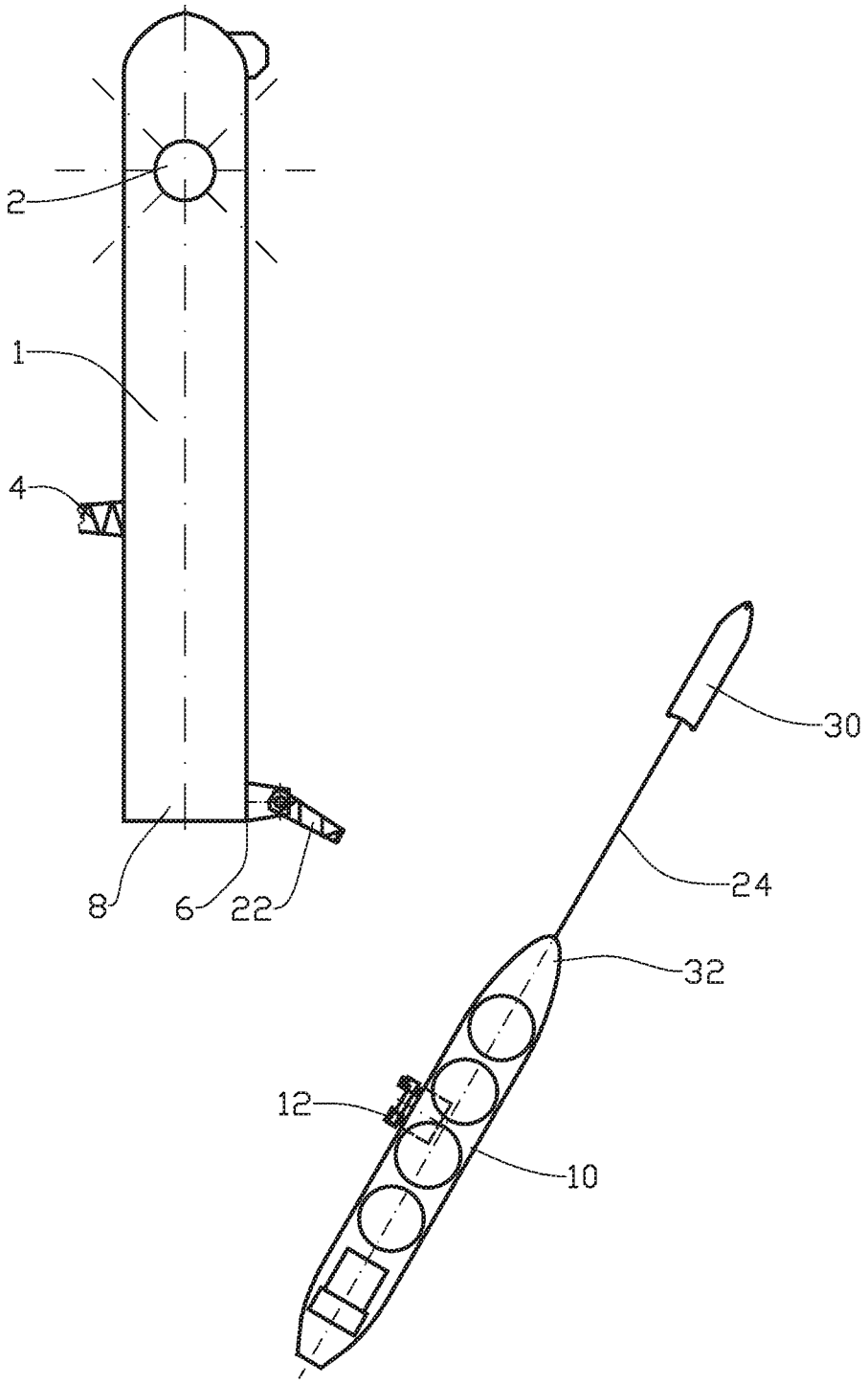
FIG. 4 shows a plane view of a situation where the second vessel is allowed to drift away from the first vessel.

In the drawings, the reference number 1 denotes a first vessel that is connected to a moored swivel 2 and that is equipped with a flare tower 4 and a cargo connection point 6. In FIGS. 1 and 4, the cargo connection point 6 is positioned at a stern portion 8 of the first vessel 1, while it is positioned mid-ships in FIG. 6. The first vessel 1 may have more than one cargo connection point 6 to enable simultaneous loading of more than one second vessel 10.

A second vessel 10 has a self-propelled buoy 12 attached close to its cargo manifold 14. A cargo connection 16 connects the self-propelled buoy 12 to the cargo manifold 14.

A cargo line 18 connects the cargo connection point 6 to the self-propelled buoy 12. A tubular line 20 that in this embodiment includes the cargo connection 16 and the cargo line 18, provides a flow path for fluid cargo between the cargo connection point 6 and the cargo manifold 14.

Figure 3:
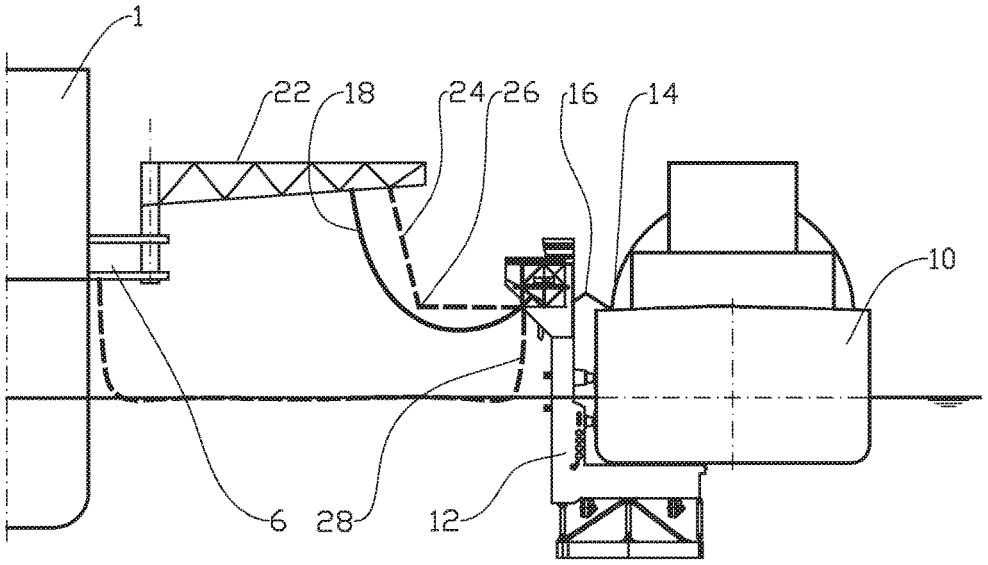
FIG. 3 shows to a larger scale an end view of the situation in FIG. 1.

The cargo line 18 is at least partly carried by a boom 22 as shown in FIG. 3. In some cases, the cargo line 18 may include a hardpipe 24 with swivels 26, or a floating or submerged hose 28 as indicated by dashed lines in FIG. 3.

A service vessel 30 is optionally attached to the bow 32 of the second vessel 10 by a hawser 34.

When cargo is to be transferred between the first vessel 1 and the second vessel 10, the self-propelled buoy 12 meets the second vessel 10 at some distance from the first vessel 1. After the self-propelled buoy 12 is attached to the second vessel 10, the self-propelled buoy 12 will bring the second vessel 10 to the first vessel 1, where the self-propelled buoy 12 will stay within predetermined distance boundaries 36, 38 from the first vessel 1. If attached, the service vessel 30 assists in keeping the second vessel 10 in a desired direction relative to the first vessel 1.

The cargo connection 16 and the cargo line 18 are connected and after normal preparations, the fluid cargo transfer is started. When finished, a reverse procedure is undertaken.

When transferring such cargo as LNG (Liquefied Natural Gas), it is normal to utilize at least one cargo line 18 for liquid transfer and a return cargo line 18 for the return of evaporated boil-off gas.

Should the resultant element forces change, the second vessel may be allowed to turn an angle 40 relative the first vessel 1 as shown in FIG. 1.

In case of an emergency, the cargo line 18 may be disconnected from the self-propelled buoy 12, after which the second vessel 10 may drift away or be moved away typically by the self-propelled buoy 12, from the first vessel 1 as shown in FIG. 4.

Figure 5:
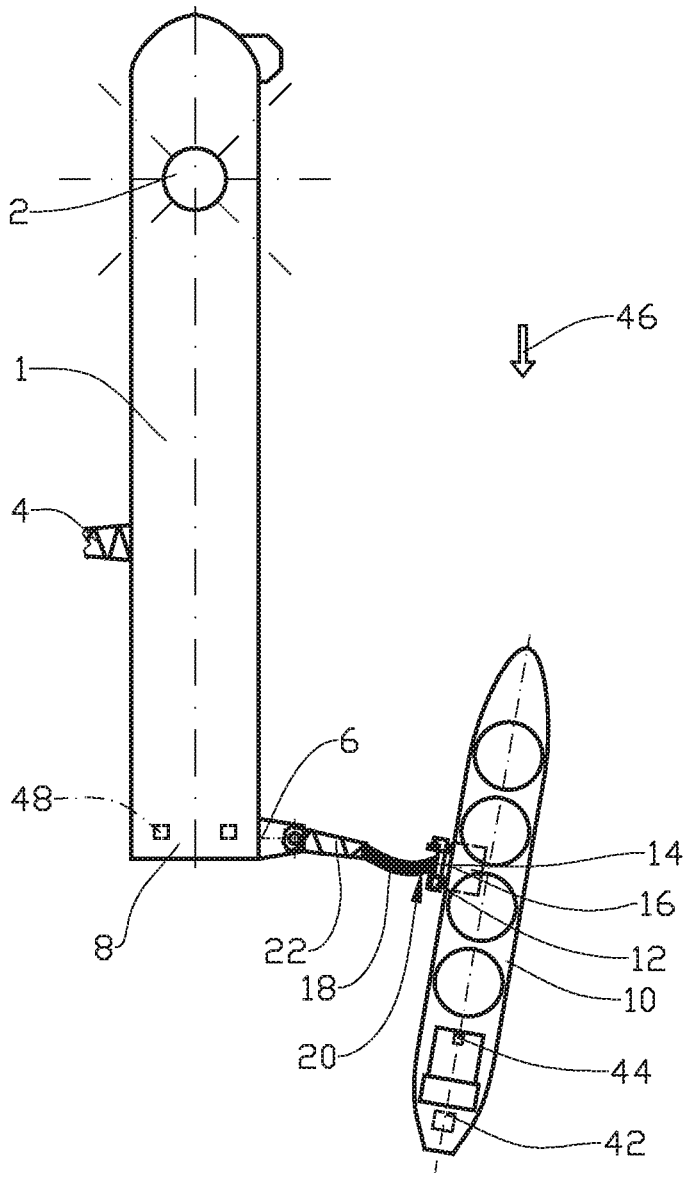
FIG. 5 shows a plane view of the first and second vessel in an alternative embodiment.

In an alternative embodiment shown in FIG. 5, the self-propelled buoy 12 is keeping the second vessel 10 in a desired position relative the first vessel 1, while a propulsion machinery 42 controlled by an auto-pilot 44 of the second vessel is, preferably automatically, maintaining the heading of the second vessel 10.

In FIG. 5 the many systems available for avoiding a collision between the first vessel 1 and the second vessel 10 is outlined.

Firstly, the first vessel 1 will weather-vane because of a resultant element force 46. The second vessel 10 may thus be positioned at the aft of the first vessel 1 and the resultant element force 46 will tend to move the second vessel 10 away from the first vessel 1. Further, in most cases, the first vessel 1 has thrusters 48 that may be used for turning the first vessel 1 away from the second vessel 10. Then the self-propelled buoy 12 may push the second vessel 10 away from the first vessel 1, and finally, the propulsion machinery 42 of the second vessel 10 may move the second vessel away.

Even at a full blackout situation in one or two of these systems, the remaining of functioning systems are sufficient to avoid a collision. Also, in the most unlikely event of simultaneous blackout of all active propulsion systems, the resultant element force 46 will push the second vessel 10 safely away from the first vessel 1.

Figure 6:
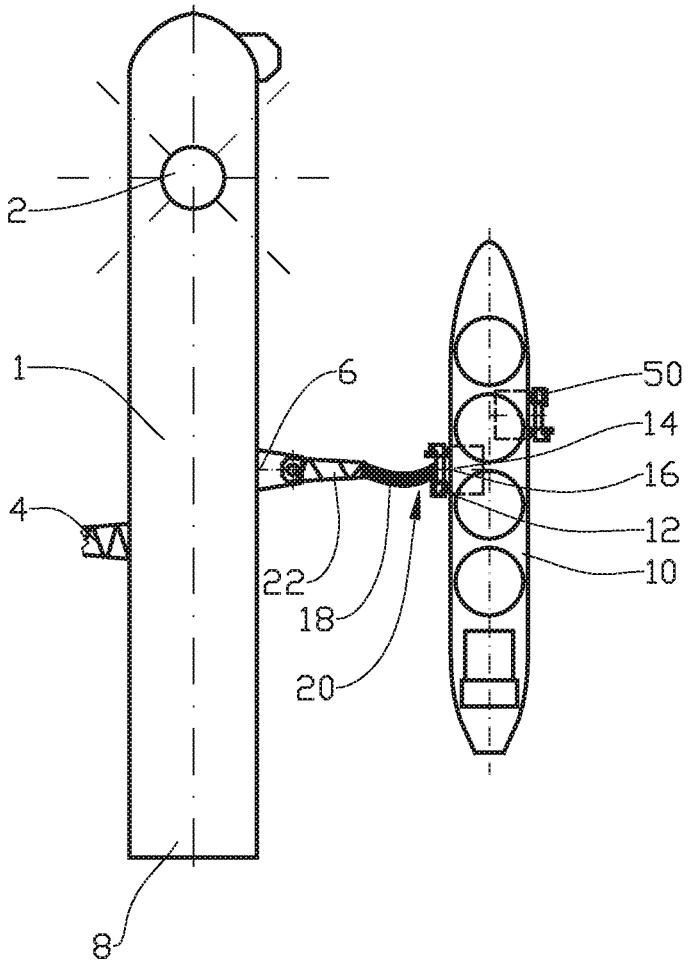
FIG. 6 shows a plane view of the first and second vessel in yet an alternative embodiment.

In another alternative embodiment shown in FIG. 6, a DPS self-propelled buoy 50 has first been attached to the second vessel 10. When the DPS self-propelled buoy 50 has brought the second vessel 10 to the first vessel 1, the self-propelled buoy 12 with connected and cooled down cargo line 18, is attached to the second vessel 1. This method significantly reduces the preparation time for cargo fluid transfer.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements.

The mere fact that certain measures are recited in mutually different dependent claims does not indicate that a combination of these measures cannot be used to advantage.

What is claimed is:

1. A method for transferring fluid cargo between a first vessel and a second vessel at open sea in a Parallel configuration, wherein the first vessel is equipped with a cargo connection point at a stern portion of the first vessel, wherein the second vessel is equipped with cargo manifold, and wherein a tubular line is connectable between the cargo connection point and the cargo manifold, the method comprising:

attaching a self-propelled buoy to the second vessel;

connecting a cargo connection between the self-propelled buoy and the cargo manifold;

connecting a cargo line between the cargo connection point and the self-propelled buoy;

transferring the fluid cargo between the cargo connection point and the second vessel; and relying on the self-propelled buoy to keep the self-propelled buoy within predetermined distance boundaries from the first vessel also when the self-propelled buoy is attached to the second vessel, the second vessel being allowed to turn at an angle relative to the first vessel.

2. The method according to claim 1, further comprising attaching the self-propelled buoy to the second vessel prior to connecting the cargo line between the cargo connection point and the self-propelled buoy.

3. The method according to claim 1, further comprising allowing the second vessel to keep the desired heading of the second vessel by use of its propulsion machinery controlled by its auto-pilot.

4. The method according to claim 1, further comprising emergency disconnecting the cargo line between the cargo connection point and the self-propelled buoy and letting the second vessel with the self-propelled buoy attached, drift off from the first vessel.

5. The method according to claim 1, further comprising attaching a DPS self-propelled buoy to the second vessel and then attaching the self-propelled buoy with the cargo line connected, to the second vessel.

6. A system that transfers fluid cargo between a first vessel and a second vessel at open sea in a Parallel configuration, wherein the first vessel is equipped with a cargo connection point at a stern portion of the first vessel and the second vessel is equipped with a cargo manifold, the system comprising:

a tubular line connected between the cargo connection point of the first vessel and the cargo manifold of the second vessel;

a cargo line extending from the cargo connection point, at least one self-propelled buoy connected to the cargo line; and a cargo connection connected between the self-propelled buoy and the cargo manifold;

wherein the self-propelled buoy is connected to the second vessel, and is configured to keep within predetermined distance boundaries from the first vessel also when the self-propelled buoy is attached to the second vessel, the second vessel being allowed to turn at an angle relative to the first vessel.

7. The system according to claim 6, wherein the first vessel is designed to weather vane.

8. The system according to claim 6, wherein the cargo connection point is at a position distant from a flare tower on the first vessel.

9. The system according to claim 6, wherein the first vessel is equipped with a support boom for the cargo line.

10. The system according to claim 6, wherein the cargo line is a hardpipe with swivels.

11. The system according to claim 6, wherein the cargo line is in the form of a submersible or floatable hose.

12. The system according to claim 6, wherein a service vessel is connectable to the second vessel.

13. A system that transfers fluid cargo between a first vessel and a second vessel at open sea in a Parallel configuration, wherein the first vessel is equipped with a cargo connection point at a stern portion of the first vessel and the second vessel is equipped with a cargo manifold, the system comprising:

a tubular line connected between the cargo connection point of the first vessel and the cargo manifold of the second vessel;

a cargo line extending from the cargo connection point;

at least one self-propelled buoy connected to the cargo line and a cargo connection connected between the self-propelled buoy and the cargo manifold;

wherein the self-propelled buoy is connected to the second vessel, and is configured to keep within predetermined distance boundaries from the first vessel also when the self-propelled buoy is attached to the second vessel, wherein, in the Parallel configuration, a longitudinal axis of the first vessel is parallel to a longitudinal axis of the second vessel which is spaced apart from and lies alongside the first vessel, and wherein the second vessel is allowed to turn at an angle relative to the longitudinal axis of the first vessel.

* * * * *